US007467931B2

(12) United States Patent
O'Toole

(10) Patent No.: US 7,467,931 B2
(45) Date of Patent: Dec. 23, 2008

(54) BLOWER SYSTEM FOR GENERATING CONTROLLED COLUMNAR AIR FLOW

(76) Inventor: John O'Toole, 10007 S. Oakley Ave., Chicago, IL (US) 60643

( * ) Notice: Subject to any disclaimer, the term of this patent is extended or adjusted under 35 U.S.C. 154(b) by 130 days.

(21) Appl. No.: 11/347,761

(22) Filed: Feb. 3, 2006

(65) Prior Publication Data

US 2006/0177324 A1 Aug. 10, 2006

Related U.S. Application Data

(60) Provisional application No. 60/650,342, filed on Feb. 4, 2005.

(51) Int. Cl.
*F04B 17/00* (2006.01)
*F04B 35/04* (2006.01)

(52) U.S. Cl. ..... 417/424.1; 417/423.1; 415/220; 416/244 R

(58) Field of Classification Search ..... 417/423.1, 417/424.1; 415/220; 416/244 R
See application file for complete search history.

(56) References Cited

U.S. PATENT DOCUMENTS

| | | | | |
|---|---|---|---|---|
| 2,221,703 | A | 11/1940 | Falco | |
| 2,301,045 | A | 11/1942 | Heath | |
| 2,625,319 | A * | 1/1953 | Reisch | 417/424.1 |
| 2,700,331 | A | 1/1955 | Miller | |
| 2,875,316 | A | 2/1959 | Ford et al. | |
| 3,223,828 | A | 12/1965 | Mast | |
| 3,320,406 | A | 5/1967 | Wainwright | |
| 3,347,025 | A | 10/1967 | Wiley | |
| 3,827,342 | A | 8/1974 | Hughes | |
| 4,560,395 | A | 12/1985 | Davis | |
| 4,628,798 | A | 12/1986 | Tagnon | |
| 4,662,912 | A | 5/1987 | Perkins | |
| 4,730,551 | A | 3/1988 | Peludat | |
| 5,001,968 | A | 3/1991 | Sodec et al. | |
| 5,078,574 | A | 1/1992 | Olsen | |
| 5,350,337 | A | 9/1994 | Kondo et al. | |
| 5,567,117 | A * | 10/1996 | Gunn et al. | 416/244 R |
| 5,624,311 | A | 4/1997 | Peludat | |
| 6,168,517 | B1 | 1/2001 | Cook | |
| 6,551,185 | B1 | 4/2003 | Miyake et al. | |
| 6,955,595 | B2 | 10/2005 | Kim | |
| 6,955,596 | B1 | 10/2005 | Walker et al. | |
| 6,974,381 | B1 | 12/2005 | Walker et al. | |

FOREIGN PATENT DOCUMENTS

| | | |
|---|---|---|
| NL | 8203932 | 5/1984 |

* cited by examiner

*Primary Examiner*—Devon C Kramer
*Assistant Examiner*—Patrick Hamo
(74) *Attorney, Agent, or Firm*—Greer, Burns & Crain, Ltd.

(57) ABSTRACT

A blower system including an air guide having at least one edge where the air guide defines a central opening. The blower system includes a power source connected to the air guide and a fan positioned in the opening and connected to the power source. The fan includes a plurality of blades having a designated height and is positioned in the opening so that at least two-thirds of the height of the blades extends beyond the edge of the air guide.

10 Claims, 3 Drawing Sheets

BLOWER SYSTEM FOR GENERATING CONTROLLED COLUMNAR AIR FLOW

PRIORITY CLAIM

This application claims priority to and the benefit of U.S. Provisional Application No. 60/650,342, filed Feb. 4, 2005, the entire contents of which are incorporated herein.

BACKGROUND

This application relates generally to techniques for distributing air in an enclosed space, such as a building or a room thereof and, more particularly, to overhead or ceiling-mounted systems.

When air of a temperature different from the ambient temperature is directed, such as by way of a heating, ventilating and air-conditioning ("HVAC") system, into a confined space (e.g., open refrigeration cases in retail stores) or entryways, air stratification tends to result. In other words, the air in the enclosed space forms temperature layers with the warmer air rising to the ceiling while the cooler area sinks to the floor.

It is known to utilize ceiling fans for moving warm air adjacent to the ceiling downward toward the floor, in an attempt to destratify the air in a building or room. However, such attempts have been unsatisfactory, since the ceiling fans either do not move the air very far or create a drafty condition. Furthermore, they are visible and may be unsightly and/or noisy. Also, they tend to create a diffuse or widely scattered air flow that can upset the air curtain adjacent to open coolers or refrigerated cases.

An attempt has been made to produce a columnar air flow by using a ceiling-mounted fan arrangement which forces air through a conical focusing ring and/or through tapering passages in a grid or a grille, such an arrangement being disclosed, for example, in U.S. Pat. No. 4,730,551. However, that arrangement is relatively complex, utilizing filters and movable grille elements, and has had mixed success in destratifying air.

SUMMARY

This application discloses an improved air destratification system and method which avoids the disadvantages of prior techniques while affording additional structural and operating advantages.

An aspect is the provision of a system which is of relatively simple and economical construction and which effectively destratifies air in an efficient manner.

One embodiment provides a blower system including an air guide having at least one edge where the air guide defines a central opening. The blower system includes a power source connected to the air guide and a fan positioned in the opening and connected to the power source. The fan includes a plurality of blades having a designated height and is positioned in the opening so that at least two-thirds of the height of the blades extends beyond the edge of the air guide.

In an embodiment, the blower system includes a housing having an open end, where the air guide is mounted to the housing.

In an embodiment, the blower system includes a grille mounted to the open end of the housing.

In an embodiment, the air guide includes a ring and a flange extending laterally outwardly from the ring.

In an embodiment, the fan includes three equiangularly-spaced blades.

In an embodiment, the power source includes an electric motor.

Another embodiment provides a blower system for generating columnar air flow including a housing having a plurality of walls defining an open end. The blower system includes a circular ring mounted to the housing, where the ring defines an opening and includes a flange extending laterally outwardly from the ring. The blower system includes a motor connected to the ring and a fan positioned in the opening and connected to the power source. The fan includes a plurality of blades having a designated height and is positioned in the opening so that at least two-thirds of the height of the blades extends beyond the flange of the air guide. A grille is mounted to the open end of the housing.

In an embodiment, at least one of the walls of the housing defines an aperture.

In an embodiment, the grille defines a plurality of openings.

In an embodiment, the fan includes three equiangularly-spaced blades.

In an embodiment, the power source includes an electric motor.

In an embodiment, the blower system includes at least one hook connected to the housing.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
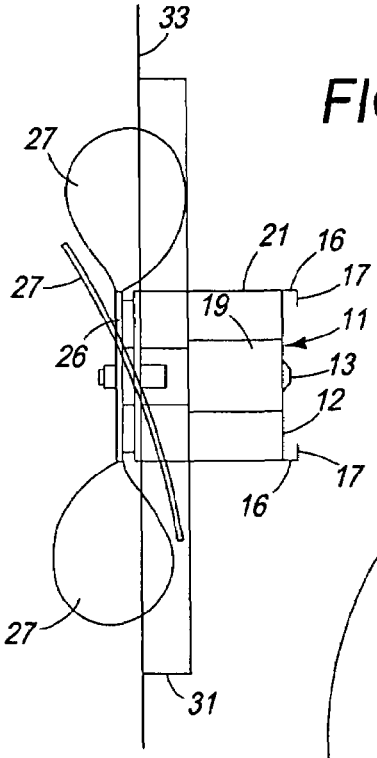
FIG. 1 is a side elevation view, in partial section, rotated 90° clockwise, of an embodiment of blower assembly.
Figure 3:
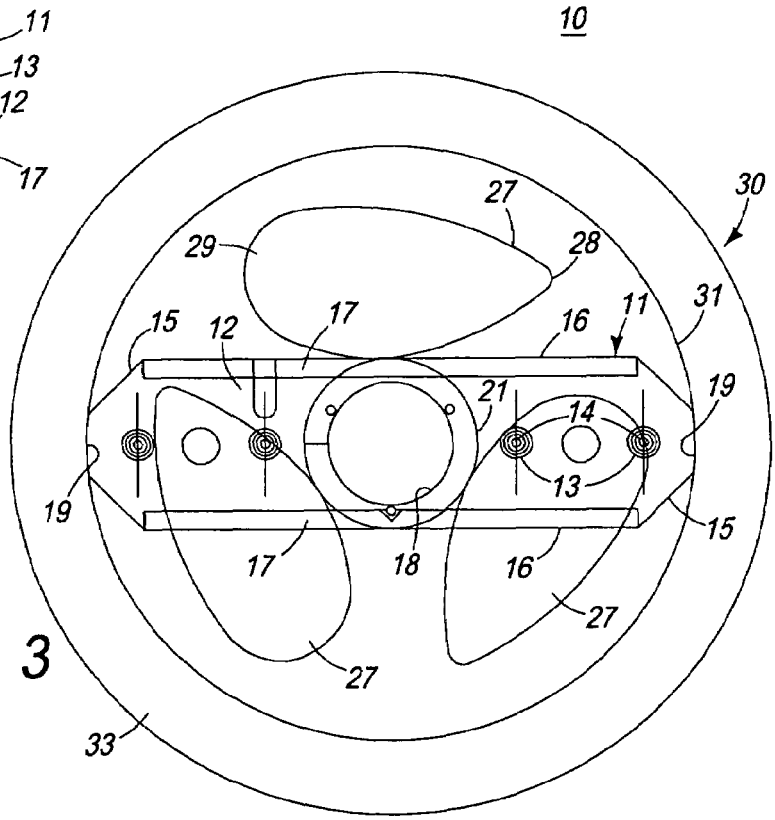
FIG. 3 is a top plan view of the assembly of FIG. 2.
Figure 2:
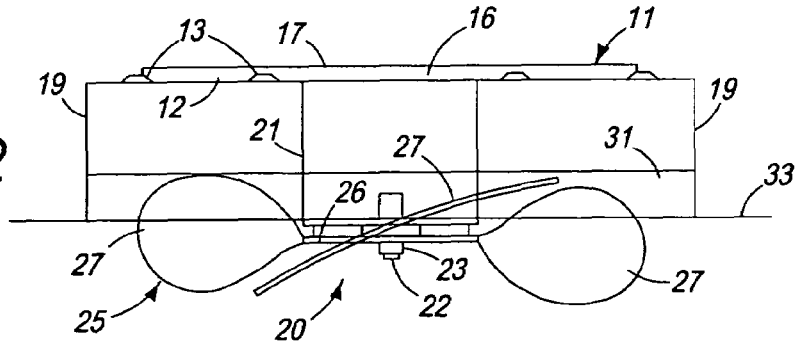
FIG. 2 is a front elevational view, in partial section, of the blower assembly of FIG. 1.

Referring to FIGS. 1-3, there is illustrated a blower assembly, generally designated by the numeral 10, which includes a mounting bracket 11, a fan assembly 20 and an air guide assembly 30. The mounting bracket 11 includes an elongated, generally rectangular base plate 12 having a plurality of mounting dimples 13 formed therein and projecting upwardly therefrom and respectively defining mounting holes 14. The base plate 12 has tapered, generally trapezoidal ends 15. Projecting upwardly from the opposite side edges of the base plate 12 between the ends 15 are upstanding vertical flanges 16, respectively provided at their distal ends with laterally inwardly projecting horizontal lips 17. A large circular central aperture is formed through the base plate 12. The tapered ends 15 are respectively integral with depending rectangular legs 19.

The fan assembly 20 includes a motor housing 21 having an output shaft 22 provided with a suitable fastener 23 for attaching to the shaft a blade assembly 25. The blade assembly 25 has a flat, annular hub 25 and a plurality of radially outwardly projecting blades 27. In the illustrated embodiment, three blades 27 are provided at equiangularly spaced-apart locations, but other numbers of blades could be utilized. Each blade 27 has a complex curved shape and is inclined to the plane of the hub 26, having a generally pointed end 28 and a blunt, rounded end 29. The motor housing 21 houses a suitable electric motor, which may be an AC motor powered by a conventional 110-volt, 60 Hz AC source.

The air guide assembly 30 includes a cylindrical ring 31 which is fixedly secured at diametrically opposed locations thereon to the lower ends of the legs 19 by suitable means, such as spot welding and the like. The ring 31 is integral at its lower edge with a laterally or radially outwardly projecting annular flange 33, which could be formed unitary with the ring 31 or could be secured thereto, as by welding.

In assembly, the upper end of the motor housing 21 is secured by suitable fasteners to the base plate 12 of the mounting bracket 11 coaxially with the central aperture 18. The parts are so dimensioned and arranged that, when fully assembled, the ring 31 will encircle the blade assembly 25 along about the upper third of the vertical extent of the blades 27, as can best be seen in FIGS. 1 and 2, so that approximately the lower two-thirds of the vertical extent of the blades 27 project downwardly below the annular flange 33.

Figure 4:
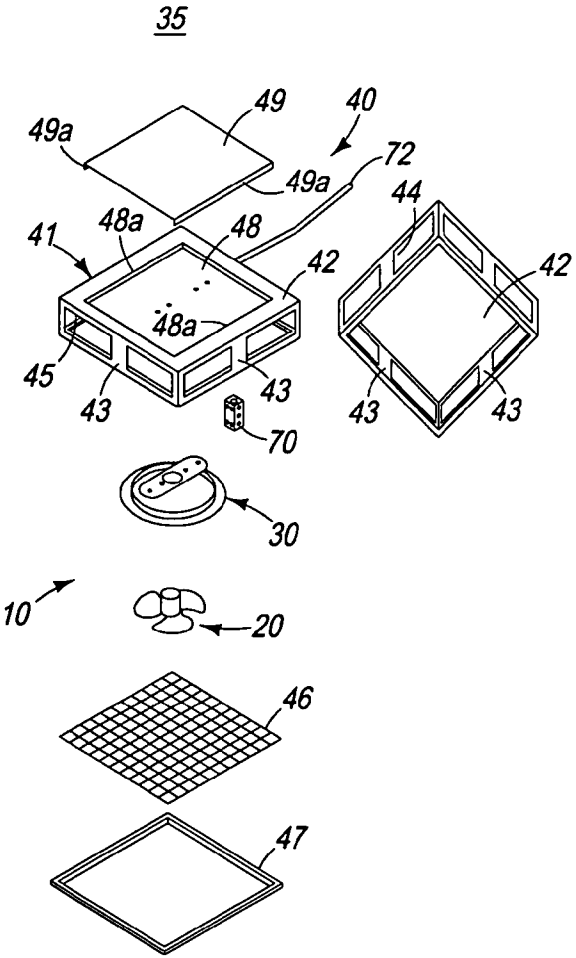
FIG. 4 is an exploded, perspective view of a system incorporating the blower assembly of FIGS. 1-3 and a first embodiment of housing assembly, incorporating both top and bottom perspective views of the housing assembly.

Referring to FIG. 4, there is illustrated a system 35 including the blower assembly 10 and an associated support assembly, such as a housing assembly 40, which is designed for surface mounting on a ceiling. The housing assembly 40 includes a rectangular, box-like housing 41 having a top wall 42 and depending side walls 43, each side wall having a pair of large, rectangular apertures 44 therethrough. Each side wall 43 is provided at its lower end with a laterally inwardly extending lip 45. The housing assembly 40 includes a rectangular grille 46 dimensioned for closing the open lower end of the housing 41 and being retained in place against the lips 45 by a rectangular retainer 47 secured in place by suitable fasteners. The housing assembly 40 includes a rectangular housing plate 48 which is secured by suitable means to the upper surface of the top wall 42 and is provided along opposed lateral side edges thereof with upstanding and laterally outwardly projecting rails 48*a*. The housing assembly 40 also includes a rectangular ceiling plate 49 provided along opposed sides thereof with depending and laterally inwardly projecting channels 49*a*, adapted to respectively receive the rails 48*a* in sliding engagement. In assembly, the fasteners which secure the fan assembly 20 to the mounting bracket 11 may also pass through the top wall 42 and the housing plate 48 to secure the parts all together in a rigid assembly. The ceiling plate 49 may then be secured by suitable means to an associated ceiling and the housing 41 may then be installed thereon by slidably inserting the rails 48*a* into the channels 49*a*.

Figure 5:
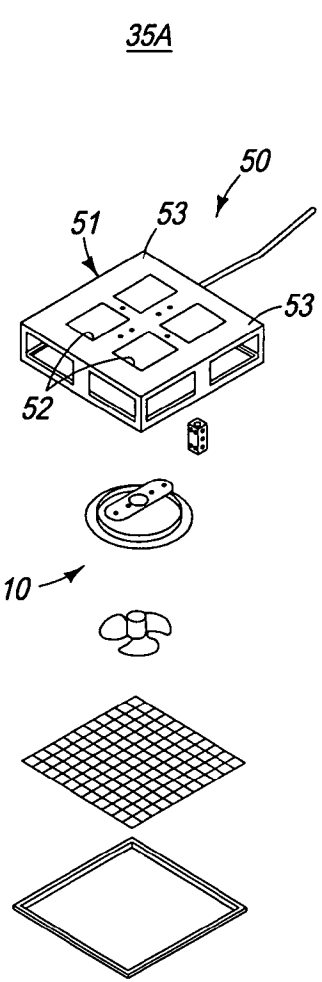
FIG. 5 is a view similar to FIG. 4 of a system utilizing a second embodiment of housing assembly.

Referring to FIG. 5, there is illustrated a modified system 35A, which is substantially the same as the system 35, except that a modified housing assembly 50 is substituted for the housing assembly 40. The housing assembly 50 includes a rectangular box-like housing 51 which is similar to the housing 41, described above, except that it is provided with a plurality of rectangular apertures 52 in the top wall thereof. Also fixed to the top wall and projecting upwardly therefrom, typically adjacent to the corners thereof, are four attachment hooks 53. In assembly, the mounting bracket 11 of the blower assembly 10 may be secured to the top wall of the housing 51 by suitable fasteners and the housing 51 may be suspended from a ceiling by suitable chains, cables or the like (not shown) respectively connected to the hooks 53.

Figure 6:
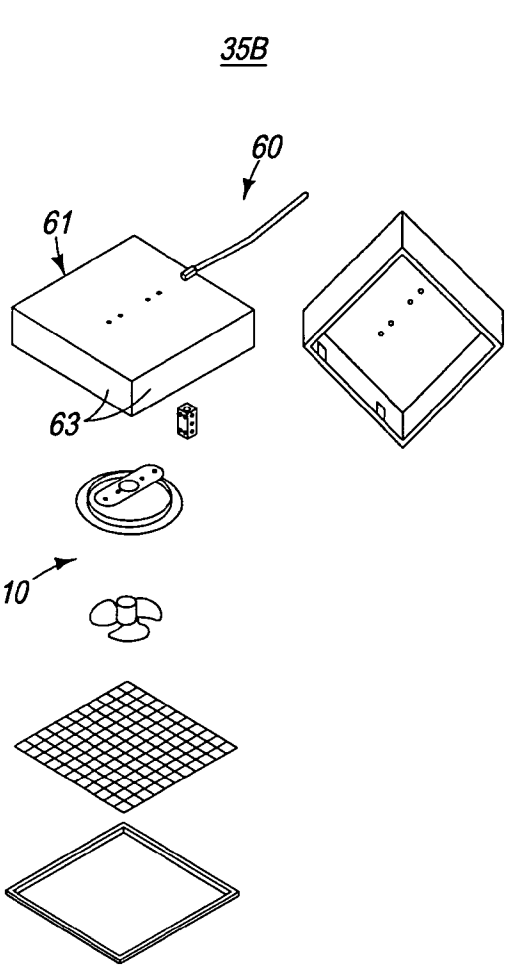
FIG. 6 is a view similar to FIG. 4, utilizing a third embodiment of housing assembly.

Referring to FIG. 6, there is illustrated another modified system 35B which, again, is similar to the system 35, except that there has been substituted for the housing 41 a housing 61, which is similar to the housing 41 except that it has depending side walls 63 with no apertures therein. The housing 61 is adapted to be mounted on the T-grid assembly of a drop ceiling in a known manner.

It will be appreciated that each of the systems 35, 35A and 35B may be provided with an electrical connector box 70 supported inside the housing 41, 51 or 61, and to which the wiring for the fan assembly 20 may be connected. The electrical connector box 70 may, in turn, be connected to an associated source of AC electric power through a suitable power cord 72 (see FIG. 4).

While each of the systems 35, 35A and 35B utilizes a housing for the blower assembly, it will be appreciated that, in certain applications, such a housing may not be necessary and the mounting bracket 11 of the blower assembly 10 may be secured by suitable means directly to an associated ceiling.

Figure 7:
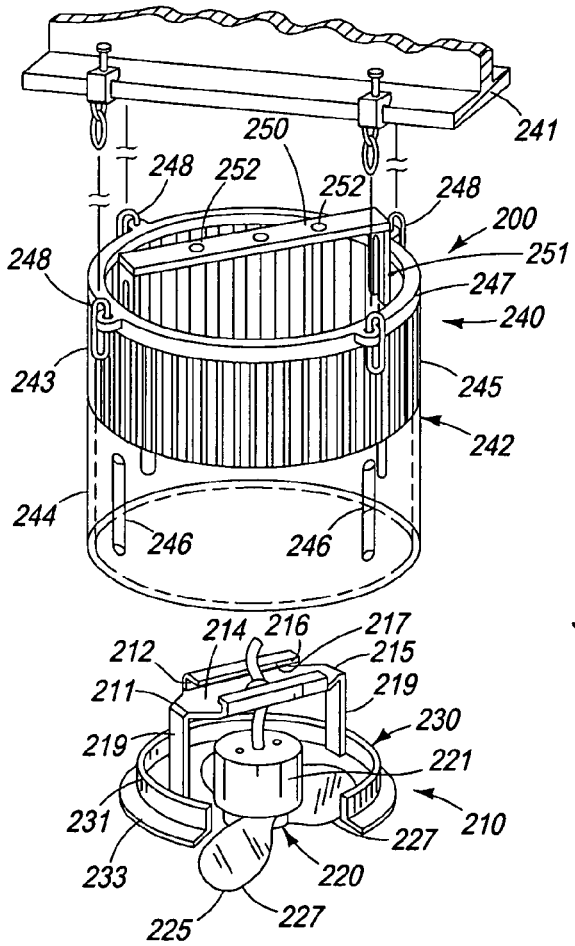
FIG. 7 is an exploded, perspective view of a second system, which includes a second embodiment of a blower assembly and a fourth embodiment of a housing assembly.
Figure 8:
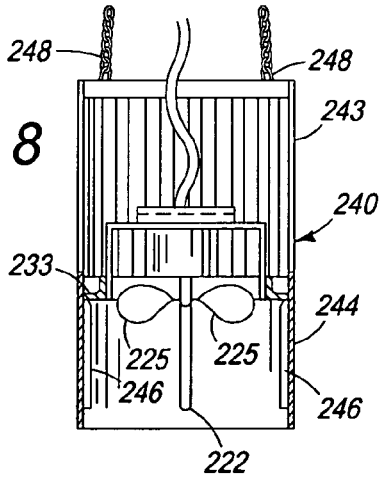
FIG. 8 is a side elevational view, taken in section, of the blower assembly and housing assembly of FIG. 7.

Referring to FIGS. 7-8, there is illustrated another example of a system 200 that includes a second embodiment of a blower assembly 210 and a fourth embodiment of a housing assembly 240. The blower assembly 210 includes a mounting bracket 211, a fan assembly 220 and an air guide assembly 230. The mounting bracket 211 includes an elongated, generally rectangular base plate 212 having one or more mounting holes 214 formed therein. The base plate 212 has tapered, generally trapezoidal ends 215. Projecting upwardly from the opposite side edges of the base plate 212 between the ends 215 are upstanding vertical flanges 216, respectively provided at their distal ends with laterally inwardly projecting horizontal lips 217. A large circular central aperture is formed through the base plate 212. The tapered ends 215 are respectively integral with depending rectangular legs 219.

The fan assembly 220 includes a motor housing 221 having an output shaft 222 provided with a suitable fastener for attaching a blade assembly 225 to the shaft 222. The blade assembly 225 has a hub (not shown) and plurality of radially outwardly projecting blades 227 connected to the hub. In the illustrated embodiment, three blades 227 are provided at equiangularly spaced-apart locations, but other numbers of blades could be utilized. Each blade 227 has a complex curved shape and is inclined to the plane of the hub. The motor housing 221 houses a suitable electric motor, which may be an AC motor powered by a conventional 110-volt, 60 Hz AC source.

The air guide assembly 230 includes a cylindrical ring 231 which is fixedly secured at diametrically opposed locations thereon to the lower ends of the legs 219 by suitable means, such as spot welding and the like. The ring 231 is integral at its lower edge with a laterally or radially outwardly projecting annular flange 233, which could be formed unitary with the ring 231 or could be secured thereto, as by welding.

In assembly, the upper end of the motor housing 221 is secured by suitable fasteners to the base plate 212 of the mounting bracket 211 coaxially with the central aperture. The parts are so dimensioned and arranged that, when fully assembled, the ring 231 will encircle the blade assembly 225 along about the upper third of the vertical extent of the blades 227, as can best be seen in FIGS. 7-9, so that approximately the lower two-thirds of the vertical extent of the blades 227 project downwardly below the annular flange 233.

Referring to FIG. 7, housing assembly 240 is designed to be hung from a ceiling or ceiling beam 241. The housing assembly 240 includes a cylindrical housing 242 having a top sidewall 243 and a bottom sidewall 244. The top sidewall 243 has a grill 245 located thereon to allow air to flow into housing 241. Alternatively, another arrangement of openings, such as a grid of holes or decorative shapes, could be used. Bottom sidewall 243 includes equidistantly spaced projecting portions 246 that are used to connect blower assembly 210 to housing assembly 240.

Top sidewall 242 includes an interface ring 247 with connectors 248, which in this case are loops that can be used to hang housing assembly 240 from a ceiling or support beam 241. A conventional hanging device, such as a rope or a chain can be attached at one end to the connecting loops and at the other end to the ceiling or support beam 241.

In another example, a mounting bracket 250 can be used to mount housing assembly directly to a ceiling. Such a bracket 250 would include legs 251 that could be attached to housing assembly 240 through known means, such as welding or screws. Bracket 250 would include holes 252 in which screws or some other fastener could be inserted to connect bracket 250 and thereby housing assembly 240 to a ceiling.

Figure 9:
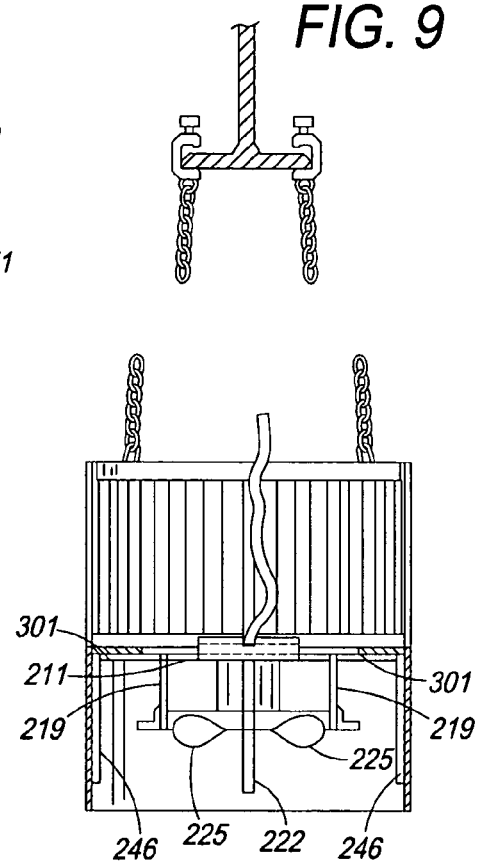
FIG. 9 is a side elevational view, taken in section, of the system of FIG. 8 utilizing a third embodiment of the blower assembly.

Referring to FIG. 8, blower assembly 210, in one example, is connected to housing assembly 240 by attaching flange 233, by spot welding or the like, directly to projecting portions 246 located on the bottom sidewall 244. FIG. 9 shows an alternative embodiment in which mounting bracket 211 is shorter in length than the inner diameter of housing 241. Mounting bracket 211 includes wings 301 which extend laterally beyond legs 219. Wings 301 are then attached to projecting portions 246 on bottom sidewall 242.

It has been found that the described systems provide a reliable columnar air flow when the blower assembly is attached to a ceiling. The blower assembly will produce a downwardly flowing column of air which, when it reaches the floor, spreads out laterally or horizontally along the floor, the air gradually rising back toward the ceiling where it is re-engaged by the blower assembly to create a continuous air circulation, which effectively destratifies the air. The columnar flow can be created with low fan speed, so as not to create a drafty condition. The localized columnar downward flow preventing interferences with air curtains of adjacent cases or cabinets.

In constructional embodiments, the mounting brackets 11, 211 may be formed of a suitable metal, the blade assemblies 25, 225 may be formed of suitable metal or plastic materials, such as high-strength fiberglass reinforced polypropylene, the air guide assemblies 30, 230 may be formed of suitable metal or plastic materials and the housing assemblies 40, 50, 60, and 240 may be formed of metal or plastic materials.

While particular embodiments have been shown and described, it will be apparent to those skilled in the art that changes and modifications may be made without departing from the principles of the blower system in its broader aspects. The matter set forth in the foregoing description and accompanying drawings is offered by way of illustration only and not as a limitation.

The invention is claimed as follows:

1. A blower system comprising:

a housing;

a ring having an inner edge attached to said housing and an opposing outer edge, said ring defining a central opening;

a flange extending laterally from said outer edge of said ring, wherein said flange separates incoming air from outgoing air;

a power source attached to said housing; and a fan positioned at least partially in said opening of said ring and connected to said power source, said fan including a plurality of blades having a designated height and being positioned in said opening so that at least two-thirds but not all of said height of said blades extends beyond said outer edge of said ring, said fan being adapted to direct air away from said fan and past said outer edge of said ring.

2. The blower system of claim 1, which includes a grille mounted to said open end of said housing.

3. The blower system of claim 1, wherein said fan includes three equiangularly-spaced blades.

4. The blower system of claim 1, wherein said power source includes an electric motor.

5. A blower system for generating columnar air flow comprising:

a housing having a plurality of walls defining an open end;

a circular ring mounted at said open end of said housing and having an outer edge, said ring defining an opening and including a flange extending laterally outwardly from said outer edge of said ring;

a motor connected to said ring;

a fan positioned at least partially in said opening and connected to said motor, said fan including a plurality of blades having a designated height and being positioned in said opening so that at least two-thirds but not all of said height of said blades extends beyond said flange of said ring; and a grille mounted to said open end of said housing.

6. The blower system of claim 5, wherein at least one of said walls of said housing defines an aperture.

7. The blower system of claim 5, wherein said grille defines a plurality of openings.

8. The blower system of claim 5, wherein said fan includes three equiangularly-spaced blades.

9. The blower system of claim 5, wherein said power source includes an electric motor.

10. The blower system of claim 5, which includes at least one hook connected to said housing.

* * * * *